United States Patent [19]

Wunder et al.

[11] 3,976,474

[45] Aug. 24, 1976

[54] COVERING LAYER FOR METALLIC BATHS

[75] Inventors: Wolf Wunder, Weisskirchen; Volker Köhne, Montabaur; Rosolde Hill, Nieder-Roden; Antonio Leogrande, Werdohl, all of Germany

[73] Assignee: Vereinigte Deutsche Metallwerke AG, Frankfurt am Main, Germany

[22] Filed: May 19, 1975

[21] Appl. No.: 578,945

Related U.S. Application Data

[63] Continuation of Ser. No. 399,510, Sept. 21, 1973, abandoned.

[30] Foreign Application Priority Data

Sept. 22, 1972 Germany ..... 2246723
May 8, 1973 Germany ..... 2323073

[52] U.S. Cl. ..... 75/96; 75/94; 106/54

[51] Int. Cl.[2] ..... C22B 9/00; C22B 9/10; C03C 3/08

[58] Field of Search ..... 75/94, 96; 106/54

[56] References Cited

UNITED STATES PATENTS

| | | | |
|---|---|---|---|
| 943,639 | 12/1909 | Rockey et al. | 75/96 |
| 1,964,321 | 6/1934 | Hood | 106/54 |
| 2,106,744 | 2/1938 | Hood et al. | 106/54 |
| 2,466,849 | 4/1949 | Hood | 106/54 |
| 2,535,536 | 12/1950 | Hagmaier | 75/94 |
| 3,110,399 | 11/1963 | Godron | 106/54 |
| 3,144,370 | 8/1964 | Bennett et al. | 106/54 |
| 3,175,937 | 3/1965 | Bayer et al. | 106/54 |
| 3,748,170 | 7/1973 | Michael | 106/54 |
| 3,765,205 | 10/1973 | Schaumberg | 106/54 |

OTHER PUBLICATIONS

"The Properties of Glass," 6. Morey 2nd Ed., Reinhold Publishing Co., N.Y. pp. 235, 250–257, (1954).

*Primary Examiner*—Patrick P. Garvin
*Assistant Examiner*—Mark Bell
*Attorney, Agent, or Firm*—Karl F. Ross; Herbert Dubno

[57] ABSTRACT

A covering layer for metallic baths, i.e. baths of molten metal or metal alloys, especially brass or brass-forming compositions consisting of premelted homogeneous finely divided alkali borosilicate glass in a particle size of less than 60 microns and a composition of substantially 10 to 70% by weight $B_2O_3$, 5 to 65% by weight $SiO_2$ and 5 to 40% by weight of one or more of the alkali-metal oxides $Na_2O$, $K_2O$ and $Li_2O$.

5 Claims, 4 Drawing Figures

COVERING LAYER FOR METALLIC BATHS

Figure 1:
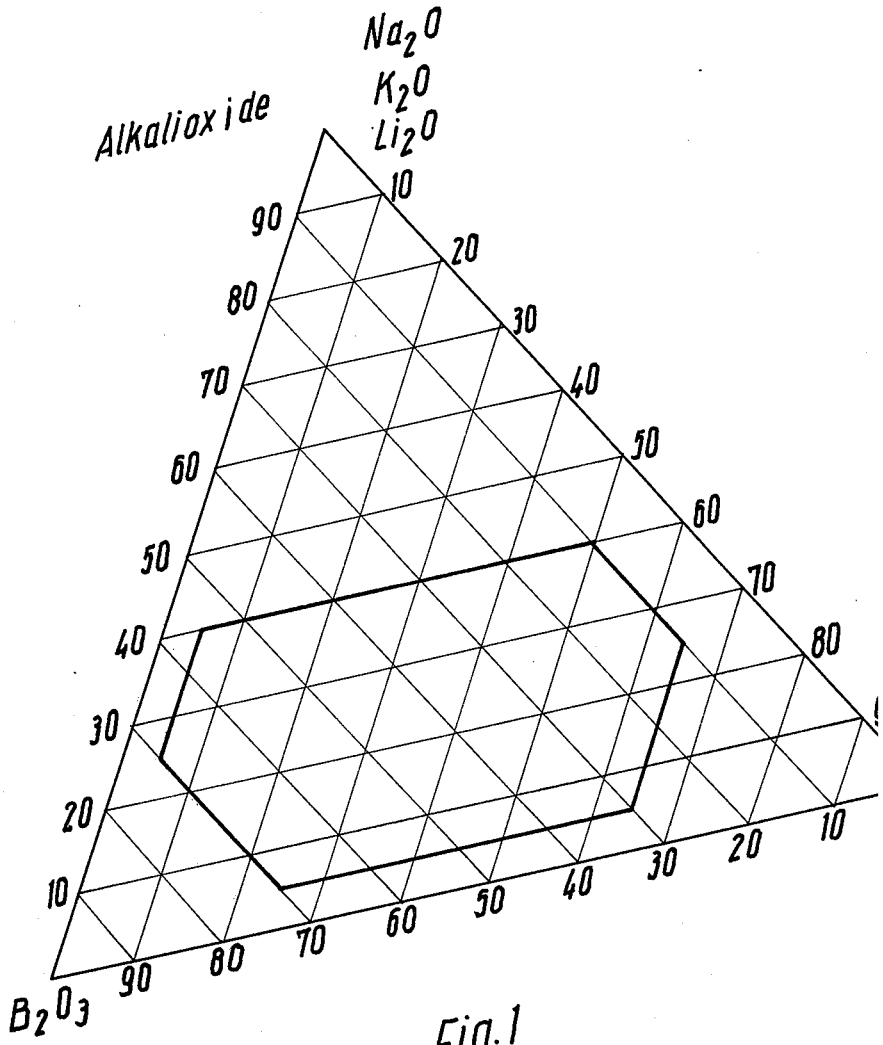

This is a continuation of application Ser. No. 399,510 filed Sept. 21, 1973, now abandoned.

1. Field of the Invention

The present invention relates to a covering layer for metallic baths, i.e. molten-metal or molten metal alloy baths, especially baths of brass or components adapted to form brass and to a method of protecting such a bath.

2. Background of the Invention

In the metallurgical industry it is common to provide a protective layer upon a metallic bath, i.e. a bath of molten metal or an alloy melt, to shield the bath from the furnace atmosphere and prevent oxidation of the bath and/or the absorption of gases from the atmosphere into the melt, to facilitate slagging of impurities drawn from the melt, and to protect the bath against heat losses through radiation and consequent temperature drops. For this purpose a uniform coherent layer of a bath covering is provided. The term "coherent" is used to refer to a covering that is self-healing in that turbulence of the layer (e.g. upon introduction of material to the bath) will be cured by the tendency of the covering material to reestablish an intact layer.

Some of the prior art materials which have been used for covering metal baths with greater or lesser success are coal, charcoal, carbon black and the like for heavy-metal alloys, and said mixtures of, for example, borax, soda, potash, feldspar, lime, cryolite and alkali-metal chlorides and carbonates for aluminum alloys or heavy-metal alloys.

A disadvantage of such salt mixtures resides in that they do not readily melt or form particularly coherent fused or liquid films and thus are ineffective for the protection of non-molten additives to the bath. During melting, however, volatile components are driven off and the covering layer boils to reduce the uniformity of the layer.

Because of the poor homogeneity, a relatively high melting point, unsatisfactory ability of the layer to be wet by or wet the melt, conventional salt mixtures have not been satisfactorily used for many metal and alloy baths.

It has also been proposed to cover molten metal baths with broken or ground glass. Since commercial glass is the source of such layers the characteristics of the layer are not always optimal with respect to wetting and film-forming characteristics, softening point, viscosity and oxidation-protective characteristics and uniformity in the interaction of the melt with the bath is frequently a problem. In many cases, impurities from the glass are introduced into the melt to the disadvantage of the metallurgical system.

3. Objects of the Invention

It is, therefore, the principal object of the present invention to provide an improved covering material or substance for metallic baths whereby the aforementioned disadvantages are obviated.

Yet another object of the invention is to provide molten metal baths with greater security against environmental or atmospheric influences.

Still another object of the invention is to provide an improved method of protecting a bath of a molten metal, especially brass, whereby the drawbacks mentioned earlier are obviated.

4. Summary of the Invention

These objects are attained, in accordance with our present invention, which is based on our surprising discovery that a certain type of glass composition can be used effectively for the coating of metal baths notwithstanding the fact that the art has, because of the experience with commercial glass, generally shied away from the use of glass for the coating of molten metal.

More particularly, we have found that alkali borosilicate glass, premelted and finely subdivided to a particle size of less than 60 microns, can be deposited on metallic melts, i.e. baths of molten metal or molten metal alloys and especially brass or brass-forming components, and provide antioxidation protection, excellent coverage of the bath surface with a low softening point and a low viscosity.

According to the invention, an alkali borosilicate glass is formed by melting 10 to 70% by weight $B_2O_3$, 5 to 65% by weight $SiO_2$ and 5 to 40% by weight of at least one of the alkali metal oxides $Na_2O$, $K_2O$ and $Li_2O$, permitting the glass melt to solidify and breaking up the solidified mass and grinding or milling the same to a particle size below 60 microns. The finely subdivided alkali borosilicate glass is then deposited upon the melt after the latter has been formed by smelting or admixture with the ingredients to be smelted into the melt.

Advantageously, when the alkali-metal oxide component is sodium oxide ($Na_2O$), it is present in an amount of 10 to 38% by weight, when this component is potassium oxide ($K_2O$) it is present in an amount of 20 to 40% by weight and when the component is lithium oxide ($Li_2O$) it is present in an amount of 5 to 30% by weight. When a mixture of the aforementioned alkali-metal oxides is employed, the total proportion of this component should be 10 to 30% by weight. The following compositions A – D have been found to be particularly advantageous:

Composition A

10 to 70% by weight $B_2O_3$
5 to 65% by weight $SiO_2$
10 to 38% by weight $Na_2O$ Composition B

10 to 70% by weight $B_2O_3$
5 to 60% by weight $SiO_2$
20 to 40% by weight $K_2O$ Composition C

20 to 70% by weight $B_2O_3$
5 to 65% by weight $SiO_2$
5 to 30% by weight $Li_2O$ Composition D

20 to 70% by weight $B_2O_3$
5 to 60% by weight $SiO_2$
10 to 30% by weight one or more of $Na_2O$, $Li_2O$ and $K_2O$.

It has been found to be particularly advantageous when a mixture of all three alkali-metal oxides is provided.

5. Description of the Drawing

The above and other objects, features and advantages of the present invention will become more readily apparent from the following description, reference being made to the accompanying drawing to which FIGS. 1 through 4 are three-component diagrams illustrating the system of the present invention.

6. Specific Description

In FIG. 1 we have shown a three-component diagram in which the lower left hand corner represents 100% $B_2O_3$, the upper corner or apex represents 100% alkali-metal oxide and the lower right hand corner represents 100% $SiO_2$. The composition outlined in bold line represents 10 to 70% by weight $B_2O_3$, 5 to 65% by weight $SiO_2$ and 5 to 40% by weight of at least one of the alkali-metal oxides $Na_2O$, $K_2O$ and $Li_2O$.

Figure 2:
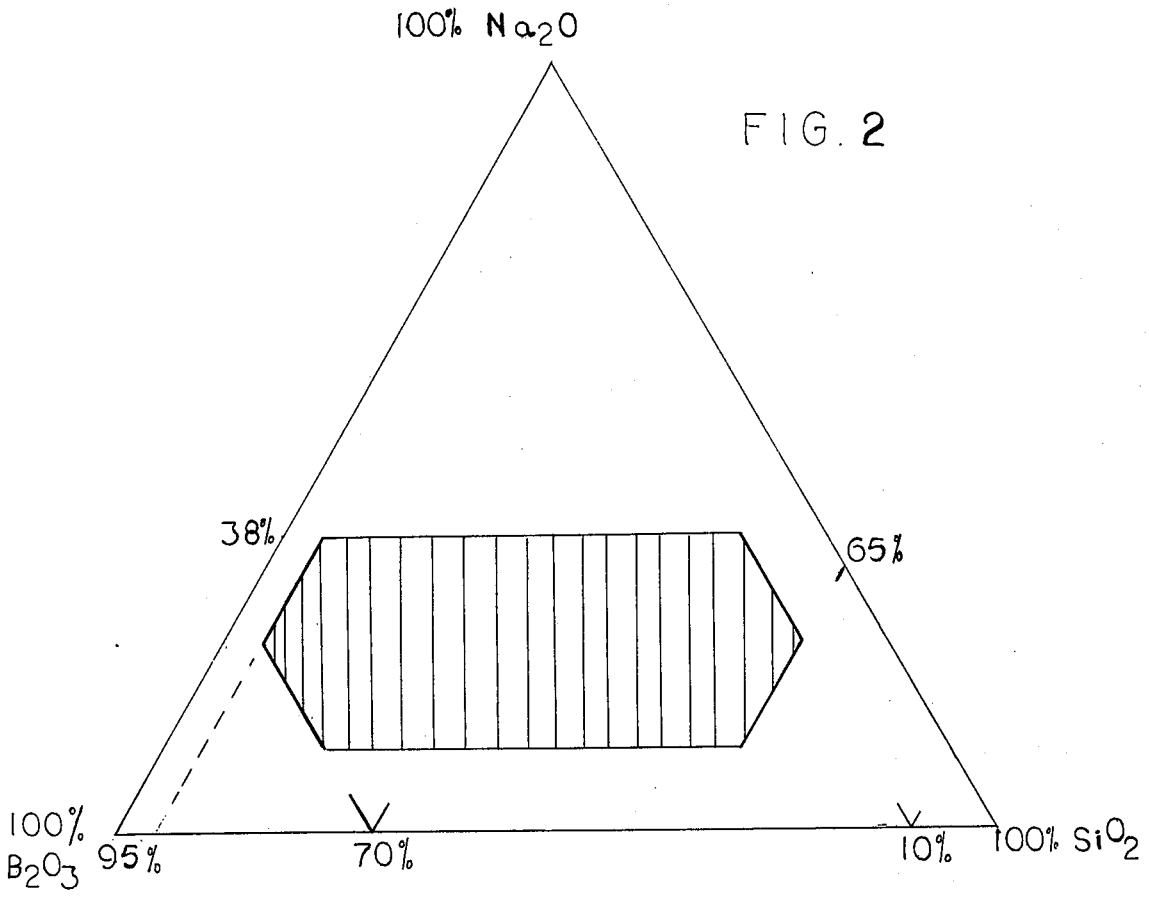
Figure 3:
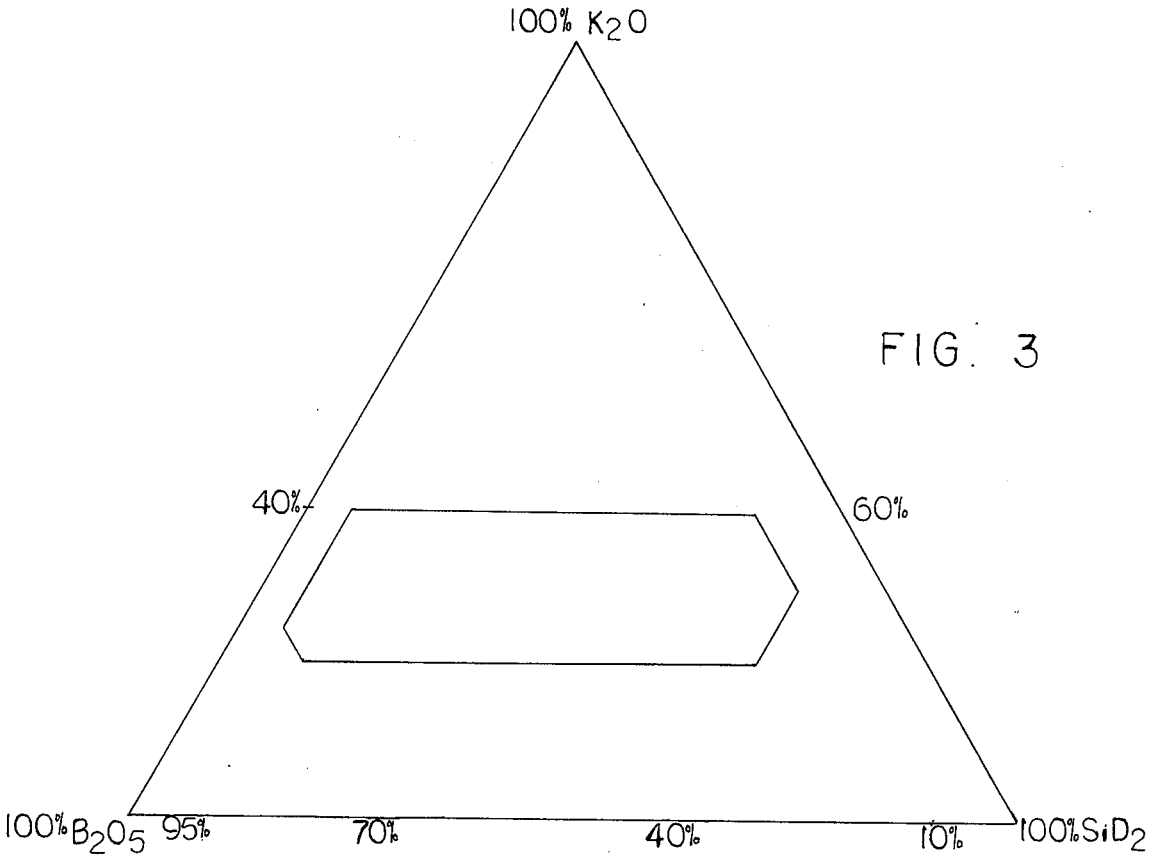
Figure 4:
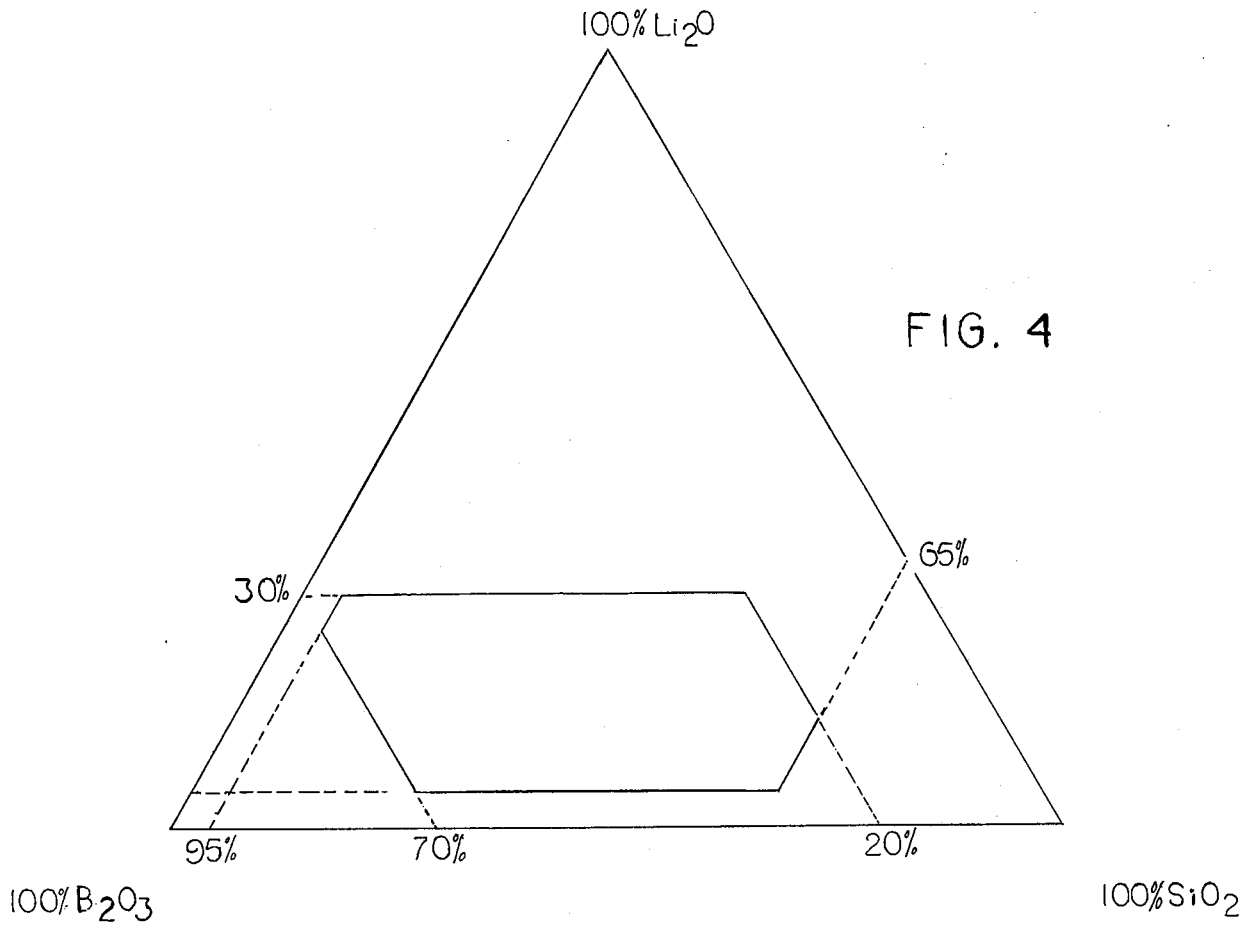

FIG. 2 is a similar diagram representing the preferred composition in the case where $Na_2O$ constitutes the alkali-metal oxide component while FIGS. 3 and 4 represent the preferred compositions when the alkali-metal components are constituted by $K_2O$ and $Li_2O$ respectively.

7. Specific Examples

EXAMPLE I 35.2% by weight $SiO_2$, 33.6% by weight $B_2O_3$ and 31.2% by weight $Na_2O$ are heated until the components fuse together to form a homogeneous glass which is thereupon cooled, broken up and ground until classification shows that the maximum particle size is less than 60 microns. The resulting mass has a softening point of 730°C, a viscosity at 730°C of 8000 poise and, when a mass of brass chips (Ms58) is melted with 0.5% of this mass mixed with chips introduced into the bath, the dross or loss is 2.51% of the total charge and 5.31% based on the material introduced.

EXAMPLE II

When 1% by weight of the covering mass of Example I is employed, the metal waste is 2.20% based on the total charge and 4.69% based on the material introduced.

EXAMPLE III

As described in Example I, a covering mass with a particle size of less than 60 microns, a softening point of 780°C and a viscosity at 850°C of 6000 poise is formed from 48.0% by weight $SiO_2$, 17.0% by weight $B_2O_3$ and 35.0% by weight $Na_2O$. When the brass charge of Example I was covered with 0.5% of this mass (admixed with the filling material), the loss was 3.24% based upon the total charge and 6.83% based upon the filling.

EXAMPLE IV

A covering material with a particle size of less than 60 microns, a softening point of 804°C and a viscosity of 6500 poise at 860°C was formed as in Example I from 39% by weight $SiO_2$, 41% by weight $B_2O_3$ and 20% by weight $LiO_2$. With brass chips (Ms58) introduced into a melt and a covering of 0.5% of this covering material, the loss was 2.91% based upon the total charge and 5.94% based upon the introduced component. Without the covering, the loss is 5.57% based upon the total charge and 11.47% based upon the brass chips added.

EXAMPLE V 35.2% by weight $SiO_2$, 41.0% $B_2O_3$ and 23.8% $Na_2O$ (all by weight) were formed into a covering mass (as described in Example I) with a particle size less than 60 microns, a softening point at 680°C and a viscosity of 6000 poise at 750°C. The loss with brass chips Ms58 added to a brass melt was 2.51% based upon the total charge and 5.31% based upon the filling material. When, instead of the 0.5% of the covering material in the case immediately above, 1.0% of the covering material was provided, the losses were 2.2% based on the total charge of 4.69% based upon the filler.

EXAMPLE VI

The covering mass was composed of glass of 55.0% by weight $SiO_2$, 18.0% by weight $B_2O_3$ and 27.0% by weight $Na_2O$. The particle size was less than 60 microns, the softening point was 770°C and the viscosity at 850° was 5500 poise. When 0.5% by weight of the covering material was applied to a brass melt formed from brass chips Ms58 the loss was 3.24% based on the total charge and 6.83% based upon the brass chips added to the charge.

We claim:

1. A method of reducing metal loss from a molten brass bath to which scrap brass, e.g. chips and wire scraps, having a large surface area/volume ratio is added, comprising the steps of melting away from said bath components for a covering material consisting of:

10 to 70% by weight $B_2O_3$
5 to 65% by weight $SiO_2$ and
5 to 40% by weight of an alkali metal oxide selected from the group which consists of $Na_2O$, $K_2O$ and $Li_2O$ to form a homogeneous molten alkali borosilicate glass;

solidifying said glass;

comminuting the solidified alkali borosilicate glass to a particle size less than 60 microns; and depositing the comminuted homogeneous alkali borosilicate glass upon said molten brass bath by mixing it with the scrap introduced into said melt in an amount of 0.5 to 1.5% of the glass based upon the weight of the scrap added to the melt.

2. The method defined in claim 1 wherein said covering material consists of:

10 to 38% by weight $Na_2O$
10 to 70% by weight $B_2O_3$ and
5 to 65% by weight $SiO_2$.

3. The method defined in claim 1 wherein said covering material consists of:

20 to 40% by weight $K_2O$
10 to 70% by weight $B_2O_3$ and
5 to 60% by weight $SiO_2$.

4. The method defined in claim 1 wherein said covering material consists of:

5 to 30% by weight $LiO_2$
20 to 70% by weight $B_2O_3$ and
5 to 65% by weight $SiO_2$.

5. The method defined in claim 1 wherein said covering material consists of:

20 to 70% by weight $B_2O_3$
5 to 60% by weight $SiO_2$ and
10 to 30% by weight of said alkali metal oxide.

* * * * *